United States Patent [19]

Steinhauer et al.

[11] 4,040,966

[45] Aug. 9, 1977

[54] FABRIC SOFTENER

[75] Inventors: Roger C. Steinhauer, Park Forest, Ill.; Richard J. Bertozzi, Phoenix, Ariz.

[73] Assignee: Armour-Dial, Inc., Phoenix, Ariz.

[21] Appl. No.: 645,871

[22] Filed: Jan. 2, 1976

[51] Int. Cl.[2] ..... D06M 13/46

[52] U.S. Cl. ..... 252/8.8; 252/8.9

[58] Field of Search ..... 252/8.8 R

[56] References Cited

U.S. PATENT DOCUMENTS

| | | | |
|---|---|---|---|
| 3,660,286 | 5/1972 | Sepulveda et al. | 252/8.8 |
| 3,749,674 | 7/1973 | Jones et al. | 252/95 |

*Primary Examiner*—John Kight, III

*Attorney, Agent, or Firm*—Frank T. Barber; Carl C. Batz; Richard G. Harrer

[57] ABSTRACT

A fabric softener containing the following essential ingredients: I — an amine oxide wherein one alkyl group attached to the nitrogen atom contains a long carbon chain and the two other alkyl groups attached to the nitrogen atom are each a methyl, ethyl, isopropyl or 2-hydroxyethyl group, II — a first quaternary ammonium compound wherein one alkyl group attached to the nitrogen atom contains a long carbon chain, and each of the three other alkyl groups attached to the nitrogen atom is methyl or ethyl, III — a second quaternary ammonium compound wherein one of the alkyl groups attached to the nitrogen atom is methyl, ethyl or 2-hydroxyethyl, two of the other alkyl groups attached to the nitrogen atom are each methyl or ethyl, and the remaining alkyl group attached to the nitrogen atom is polyoxypropylene, and IV — a third quaternary ammonium compound wherein two alkyl groups attached to the nitrogen atom are each methyl or ethyl, one of the remaining alkyl groups attached to the nitrogen atom is phenylalkyl and the other remaining alkyl group attached to the nitrogen atom is methyl, ethyl, or phenylalkyl and in which the third quaternary ammonium compound contains at least some amount in which two phenylalkyl radicals are contained.

19 Claims, No Drawings

FABRIC SOFTENER

This invention relates to a fabric softening composition and more particularly to a composition which is compatible with detergents and can be used in the wash cycle.

BACKGROUND

The demand for fabric softeners has grown very substantially in the past few years and it is said that a majority of the households in the United States use some type of fabric softener in the washing of fabrics. For convenience of use, the fabric softener should be compatible with the commonly used detergents. It is not easy to find a fabric softener which is compatible with the detergents commonly used or if it be compatible, which will not disturb the effectiveness of the detergents. Further difficulty arises because the fabric softening composition must not have other shortcomings such as objectionable odor or tendency to stain fabrics. Compositions which may be found to be compatible with detergents may be found to be unstable or may be found to stain fabrics or produce yellowing or graying of the fabrics, or they may be found to have an undesirable odor or objectionable color. Substantially all of the fabric softening compositions tend to kill the effect of the perfume which may be added to the wash or contained in the softening composition itself.

A softener composition which would overcome the difficulties above mentioned and satisfy the requirements above referred to has long been needed but has not been available in the prior art. The search for such a composition has further been complicated by the fact that no ingredient can be counted on to perform its previously known function when incorporated in a different combination of ingredients. It is common that when two ingredients are combined, one of them may nullify the effect of the other one, or their combination may produce an effect which is quite foreign to either of them. It is usually impossible to tell, for example, if any previously untried combination will or will not stain the fabric in some way.

SUMMARY

We have discovered a fabric softening composition which in our tests meets the needs for the ideal fabric softener better than any such composition previously known. The improved composition contains four special ingredients in combination. One of these ingredients is a type of amine oxide in which one of the alkyl groups contains a long carbon chain and the other two alkyl groups are methyl or ethyl. The other three compounds are each special but different types of quaternary ammonium compounds which will be specifically described in the following detailed description.

DETAILED DESCRIPTION

The amine oxide ingredient contained in our improved fabric softening composition may be represented as follows:

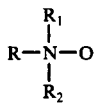

in which R is an alkyl radical containing a carbon chain of from 8 to 22 carbon atoms. (In this specification and claims, the word "alkyl" is understood to embrace the unsaturated or alkylene form as well as the saturated form of the radical), and $R_1$ and $R_2$ are each separately methyl or ethyl, preferably methyl. We prefer to use the amine oxides of the above formula in which R contains a carbon chain of from 14 to 18 carbon atoms and the best results are to be obtained when R contains 16 carbon atoms.

In our improved fabric softening compositions we may use the amine oxide ingredient in an amount in the range of from 0.1 to 35 weight percent of our improved composition, but prefer to use this ingredient in the amount in the range of from 2 to 12 weight percent, with the best results being obtained when it is contained in an amount of about 4 weight percent. The percentages of the amine oxide ingredient as above given are based on the dry weight of the amine oxide and the total weight of the composition.

The first quaternary ammonium compound may be represented as follows:

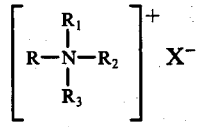

wherein R is an alkyl radical having a carbon chain of from 8 to 22 carbon atoms, preferably from 14 to 18 carbon atoms, and for best results 16 carbon atoms, $R_1$, $R_2$ and $R_3$ are each separately methyl or ethyl preferably methyl, and X is an anion. X may be, for example, chlorine, bromine, florine, ethyl sulfate, methyl sulfate or $SO_4$.

This first quaternary ammonium compound is contained in our improved fabric softening compositions in an amount within the range of 0.1 to 45 weight percent based on the dry weight of the compound and the total weight of the composition; preferably this percentage is from 2 to 12 weight percent, and ideally it is about 4 weight percent. As between the amount of the amine oxide and the first quaternary ammonium compound, we prefer that the quaternary ammonium compound be contained in an amount of from 35 to 65 weight percent based on the weight of the quaternary ammonium compound and the weight of both the amine oxide and the quaternary ammonium compound, with the best conditions being when the amine oxide and quaternary ammonium compound are contained in approximately equal quantities.

As the second quaternary ammonium compound we prefer to use a compound having the following formula:

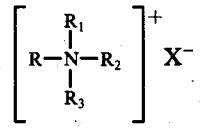

in which:

R is methyl, ethyl or 2 hydroxyethyl, preferably methyl, $R_1$ and $R_3$ are each ethyl or methyl, preferably ethyl, $R_2$ is $CH_2(CH_2CH_2O)_nH$, where $n$ is from 8 to 41, preferably 8, and X is chlorine, bromine, idodine, ethyl sulfate, methyl sulfate or acetate.

This second quaternary ammonium compound may be contained in an amount of from 0.1 to 60 weight percent based on the dry weight of the compound and the total weight of the composition, preferably from 1.5 to 20 weight percent and ideally about 3.5 weight percent.

The third quaternary ammonium compound is represented by the formula:

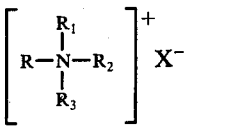

in which:

R is phenylalkyl in which the alkyl group contains a chain of 8 to 22 carbons, preferably 14 to 18 carbons and ideally 16 carbons, $R_1$ and $R_2$ are each methyl or ethyl, $R_3$ is methyl, ethyl, or phenylalkyl in which the alkyl group contains a chain of 8 to 22 carbons, preferably 14 to 18 carbons and ideally 16 carbons, and X is chlorine, bromine, iodine, ethyl sulfate or methyl sulfate.

This third quaternary ammonium compound may be contained in an amount of from 0.1 to 60 weight percent based on the dry weight of the compound and the total weight of the composition, preferably from 1.5 to 20 weight percent and ideally about 3.5 weight percent.

In this third quaternary ammonium compound it is desirable that R and $R_3$ each be phenylalkyl with the alkyl radical in each containing from 8 to 22, preferably 14 to 18 and ideally 16 carbon atoms, and that this diphenylalkyl form be contained in the compound in a dry weight amount of from 40 to 100 percent, based on the weight of the total third quaternary ammonium compound.

Also perfumes may be added, and as will be hereinafter explained, the perfumes become substantive in our special fabric softening compositions and retains their effectiveness for an unexpectedly long period. The perfume ingredient may be added in an amount of from 0 to 5.0 weight percent based on the weight of the perfume and the total weight of the compositions, preferably from 0.05 to 1.0 weight percent, and ideally about 0.25 weight percent.

The alkyl radicals containing long carbon chains of 8 to 22 carbon atoms may be derived from the acids of naturally occuring oils. For example, coconut oil, tallow or palm oil contain fatty acid mixtures having carbon chains of suitable length. The natural fatty acids may be utilized as mixtures of different chain lengths to make up the radicals designated or the mixtures may be fractionated to cause certain chain lengths to predominate. When the natural mixtures are used the terms "coco" or "tallow" may be used to designate the radical being referred to.

When the amine oxide and the different essential ingredients are prepared or purchased they usually are in solution form in which they are contained in quantities of isopropanol and water. They may be used in this form to make up our compositions, and the diluent contained in the several ingredients will be present in the total composition. Added isopropanol and added water are also included in the total composition, but for purposes of convenience in this disclosure we designate the amount of the ingredient on a weight basis excluding water and other diluent and include the weight of both dry ingredient and the weight of the diluent in the total weight of the composition.

We prefer to include in our compositions from 2 to 98 weight percent of isopropanol which may be contained with the ingredients based on the weight of the ingredients and the total weight of the composition. For better results this percentage may be 5 - 36 weight percent, and ideally 8 - 9 weight percent. Water may be included in an amount of 0 to 96 weight percent based on the weight of total water and total weight of the composition.

Our special combination of essential ingredients makes it practical to prepare concentrated fabric softener products with little or no water. We can prepare compositions having a water content of, for example, 12 to 0 percent. This is an added convenience since the same softening effect can be obtained with only a small amount of the composition. The concentrated form of the composition becomes practical because this special composition is highly effective but at the same time does not stain or otherwise damage fabrics even when used in high concentration.

It is also a substantial advantage that our improved fabric softener is a clear liquid and therefore appears most attractive to the consumer. Ideally a small amount of blue dye may be included to present the best possible appearance to the consumer for a fabric softener.

In addition to the above described ingredients we may also add brighteners and dyes for their known properties.

In the preparation of our total composition, the ingredients may be assembled and mixed together. The resulting composition makes a liquid which, without benefit of dyes, is clear and light yellow in color. In use it may be added either to the wash or to the rinse cycle at whatever time in either cycle the user may choose. It may be placed in an empty washing machine and the water, detergent and fabrics added, and may be used in the amounts in which fabric softening compositions have been used in the prior practice. It serves very effectively the fabric softening function and even though it may contact the fabrics directly it does not stain the fabrics. It inhibits the build-up of static electricity on the fabrics. Further, in some way not fully understood, it promotes the effectiveness of perfume, causing the washed fabric to continue to have a pleasing odor.

The use of our improved fabric softener composition, whether in the rinse or wash cycle, has been found not to reduce the effectiveness of the detergent to any substantial degree, and under some conditions actually boosts the effectiveness of the detergents used. We find that the non-ionic type of detergents are enhanced by the presence of our fabric softeners and that even the effectiveness of the anionic phosphate built type of detergent is not affected to any critical extent.

To further demonstrate our improved fabric softening compositions we give the following specific examples:

In the following examples 1 to 10 we list the ingredients in various formulations and give their proportions based on the dry weight of the total active ingredients in the total composition.

It is understood that the amine oxide or any of the quaternary ammonium compounds each may contain different specific compounds which are within the generic designation for such ingredient and in the following specific examples we will give both the generic and the specific designations of the compounds utilized.

EXAMPLE I

| INGREDIENT | WEIGHT PERCENT OF TOTAL WEIGHT |
|---|---|
| Amine Oxide | |
| Dimethyl hexadecyl amine oxide | 3.5 |
| First quaternary ammonium compound | |
| Monotallowtrimethyl ammonium chloride | 2.0 |
| Dodecyltrimethyl ammonium chloride | 1.0 |
| Second quaternary ammonium compound | |
| Diethylmethyl polypropoxy ammonium chloride | 3.5 |
| Third quaternary ammonium compound | |
| Phenylstearyl trimethyl ammonium chloride | 1.5 |
| Dimethyl diphenylstearyl ammonium chloride | 1.0 |
| Brighteners | 0.085 |
| Perfume | 0.25 |
| Isopropanol | 9.0 |
| Water (deionized) | 78.165 |
| TOTAL | 100.00 |

EXAMPLE II

| INGREDIENT | WEIGHT PERCENT OF TOTAL WEIGHT |
|---|---|
| Amine Oxide | |
| Dimethyl hexadecyl amine oxide | 4.0 |
| First quaternary ammonium compound | |
| Hexadecyl trimethyl ammonium chloride | 4.0 |
| Second quaternary ammonium compound | |
| Diethylmethyl polypropoxy ammonium chloride | 3.5 |
| Third quaternary ammonium compound | |
| Dimethyl diphenylstearyl ammonium chloride | 3.0 |
| Brighteners | 0.08 |
| Perfume | 0.3 |
| Isopropanol | 11.0 |
| Water (deionized) | 74.12 |
| TOTAL | 100.00 |

EXAMPLE III

| INGREDIENT | WEIGHT PERCENT OF TOTAL WEIGHT |
|---|---|
| Amine Oxide | |
| Dimethylcocoamine oxide | 4.0 |
| First quaternary ammonium compound | |
| Monococotrimethyl ammonium chloride | 4.0 |
| Second quaternary ammonium compound | |
| Diethylmethyl polypropoxy ammonium chloride | 3.0 |
| Third quaternary ammonium compound | |
| Dimethyl diphenylstearyl ammonium chloride | 1.5 |
| Phenylstearyl trimethyl ammonium chloride | 1.5 |
| Brighteners | 0.08 |
| Perfume | 0.2 |
| Isopropanol | 11.0 |
| Water (Deionized) | 74.72 |
| TOTAL | 100.00 |

EXAMPLE IV

| INGREDIENT | WEIGHT PERCENT OF TOTAL WEIGHT |
|---|---|
| Amine Oxide | |
| Dimethylhexadecyl amine oxide | 12.0 |
| First quaternary ammonium compound | |
| Monococotrimethyl ammonium chloride | 12.0 |
| Second quaternary ammonium compound | |
| Diethylmethyl polypropoxy ammonium chloride | 10.0 |
| Third quaternary ammonium compound | |
| Dimethyl diphenylstearyl ammonium chloride | 10.0 |
| Brighteners | 0.25 |
| Perfume | 0.75 |
| Isopropanol | 43.0 |
| Water (Deionized) | 12.0 |
| TOTAL | 100.00 |

EXAMPLE V

| INGREDIENT | WEIGHT PERCENT OF TOTAL WEIGHT |
|---|---|
| Amine Oxide | |
| Dimethylhexadecyl amine oxide | 15.1 |
| First quaternary ammonium compound | |
| Monococotrimethyl ammonium chloride | 15.1 |
| Second quaternary ammonium compound | |
| Diethylmethyl polypropoxy ammonium chloride | 13.2 |
| Third quaternary ammonium compound | |
| Dimethyl diphenylstearyl ammonium chloride | 13.2 |
| Brighteners | 0.32 |
| Perfume | 0.93 |
| Isopropanol | 42.15 |
| Water (Deionized) | 0 |
| TOTAL | 100.00 |

EXAMPLE VI

| INGREDIENT | WEIGHT PERCENT OF TOTAL WEIGHT |
|---|---|
| Amine Oxide | |
| bis(2-hydroxyethyl) cocoamine oxide | 4.0 |
| First quaternary ammonium compound | |
| Dodecyltrimethyl ammonium chloride | 4.0 |
| Second quaternary ammonium compound | |
| Diethyl 2-hydroxyethyl polypropoxy ammonium acetate | 3.5 |
| Third quaternary ammonium compound | |
| Dimethyldiphenylstearyl ammonium Chloride | 3.5 |
| Brighteners | 0.08 |
| Perfume | 0.2 |
| Isopropanol | 9.42 |
| Water (Deionized) | 75.30 |
| TOTAL | 100.00 |

EXAMPLE VII

| INGREDIENT | WEIGHT PERCENT OF TOTAL WEIGHT |
|---|---|
| Amine Oxide | |
| Dimethylhexadecyl amine oxide | 6.0 |
| First quaternary ammonium compound | |
| Monotallowtrimethyl ammonium chloride | 3.0 |
| Dodecyltrimethyl ammonium chloride | 3.0 |
| Second quaternary ammonium compound | |
| Diethylmethyl polypropoxy ammonium chloride | 4.0 |

-continued

| INGREDIENT | WEIGHT PERCENT OF TOTAL WEIGHT |
|---|---|
| Third quaternary ammonium compound | |
| Dimethyldiphenylstearyl ammonium chloride | 3.0 |
| Trimethylphenylstearyl ammonium chloride | 3.0 |
| Brighteners | 0.1 |
| Perfume | 0.3 |
| Isopropanol | 14.0 |
| Water (Deionized) | 63.6 |
| TOTAL | 100.00 |

EXAMPLE VIII

| INGREDIENT | WEIGHT PERCENT OF TOTAL WEIGHT |
|---|---|
| Amine Oxide | |
| Dimethylhexadecyl amine oxide | 2.0 |
| Dimethylcoco amine oxide | 2.0 |
| First quaternary ammonium compound | |
| Monococotrimethyl ammonium chloride | 4.0 |
| Second quaternary ammonium compound | |
| Diethylmethyl polypropoxy ammonium chloride | 3.5 |
| Third quaternary ammonium compound | |
| Dimethyldiphenylstearyl ammonium chloride | 3.5 |
| Brighteners | 0.08 |
| Perfume | 0.25 |
| Isopropanol | 9.70 |
| Water (Deionized) | 74.97 |
| TOTAL | 100.00 |

EXAMPLE IX

| INGREDIENT | WEIGHT PERCENT OF TOTAL WEIGHT |
|---|---|
| Amine oxide | |
| Dimethylcocoamine oxide | 3.5 |
| First quaternary ammonium compound | |
| Monococotrimethyl ammonium chloride | 3.5 |
| Second quaternary ammonium compound | |
| Diethyl 2-hydroxyethyl polypropoxy ammonium acetate | 3.5 |
| Third quaternary ammonium compound | |
| Dimethyldiphenylstearyl ammonium chloride | 1.5 |
| Trimethylphenylstearyl ammonium chloride | 2.0 |
| Brighteners | 0.08 |
| Perfume | 0.2 |
| Isopropanol | 9.0 |
| Water (Deionized) | 76.72 |
| TOTAL | 100.00 |

EXAMPLE X

| INGREDIENTS | WEIGHT PERCENT OF TOTAL WEIGHT |
|---|---|
| Amine Oxide | |
| Dimethylhexadecylamine oxide | 3.5 |
| First quaternary ammonium compound | |
| Monotallowtrimethyl ammonium chloride | 2.0 |
| Dodecyltrimethyl ammonium chloride | 1.0 |
| Second quaternary ammonium compound | |
| Diethylmethyl polypropoxy ammonium chloride | 3.0 |
| Third quaternary ammonium compound | |
| Dimethyldiphenylstearyl ammonium chloride | 1.5 |
| Trimethylphenylstearyl ammonium chloride | 1.5 |

-continued

| INGREDIENTS | WEIGHT PERCENT OF TOTAL WEIGHT |
|---|---|
| Brighteners | 0.08 |
| Perfume | 0.2 |
| Isopropanol | 7.5 |
| Water (Deionized) | 79.72 |
| TOTAL | 100.00 |

EXAMPLE XI

In order to demonstrate the effectiveness of our fabric softeners as to the function of softening fabrics, i.e., to give them a supple hand, two lots of terry cloth towels were obtained. Towels from one of these lots were washed using one cup of a leading national brand detergent only. Towels from the other lot were washed using the same detergent in the same amount with the addition of three ounces of fabric softener according to the formulation of Example I.

A panel was assembled consisting of eight persons and the washed towels from each lot were presented to the panelists on a blind basis, the panelists being asked to give their preference as to softness qualities. All eight panelists indicated their preference for towels which were identified as having been washed using the detergent along with the softener. These same towels were washed through three washings and five washings. In each instance, the panelist selected as preferable as to softness the towels which had been washed repeatedly using the detergent and the softener.

EXAMPLE XII

In order to test the effect of our softener composition on detergency, we compared our softeners with a leading wash cycle softener now on the market with respect to different types of detergents.

Soiled test cloths were obtained from commercial supply houses. The cloths were laundered in a TERG-O-TOMETER machine using the water of 135 ppm hardness at 120° F. Detergents tested were: (A) a leading anionic built detergent, (B) a leading nonionic built detergent, (C) a leading non-phosphate built detergent, and (D) a leading heavy duty liquid detergent. Test cloths were washed using each of these detergents comparing the percent of soil removal for an average of five cloths, using each detergent alone (with the percentage of soil removed) using the same detergent and 3 ounces of Applicant's Example I softener, and also (with the percentage of soil removed) using the same detergent and three ounces of a leading wash cycle softener. The results of the tests are given as follows:

| | | % soil removal-5 cloth average |
|---|---|---|
| (A) | A leading anoinic built detergent | 40 |
| | The same detergent + Example I softener | 36 |
| | The same detergent + a leading wash cycle softener | 28 |
| (B) | A leading nonionic built detergent | 31 |
| | The same detergent + Example I softener | 40 |
| | The same detergent + a leading wash cycle softener | 27 |
| (C) | A leading non-phosphate built detergent | 31 |
| | The same detergent + Example I softener | 33 |
| (D) | A leading heavy duty liquid detergent | 32 |
| | The same detergent + Example I softener | 33 |

EXAMPLE XIII

To determine the effect of our softeners on static build-up, we made the following tests:

Identical wash loads of permanent press and synthetic fabrics were washed one with the detergent alone and the other with the same detergent plus the softener of Example I added (3 ozs.). The fabrics were dried in the same way, in a home laundry dryer at the same temperature. In all cases, visual observation of the clothes when removed from the dryer showed less static electricity in loads washed in detergent containing the softener. The loads which had not been subjected to the softener showed significant static electricity build-up as evidenced by clinging of the fabrics and crackling static discharge.

EXAMPLE XIV

To determine if our softeners give perfume substantivity identical loads of laundry were washed, one with detergent alone, and the other with the same detergent in the same amount with 3 ounces of Example I softener. After the clothes were removed from the dryers they were checked for odor by a perfume expert and by several laboratory personnel on a blind paired comparison basis. The clothes which were washed in the presence of the softener were judged to have a clean, fresh fragrance which lasts for weeks. It was apparent that the fragrance survived the wash, rinse, and drying cycles. This was regarded as surprising and unexpected. Although we can not be certain as to the mechanism by which perfume substantivity is obtained, we may postulate that this effect comes about as a result of a co-deposition mechanism of perfume with the softener.

EXAMPLE XV

To determine if our softeners may have a tendency to stain fabrics, especially when and if the softener should come in direct contact with the fabric, the softener of Example I was poured directly on a wide variety of dry fabrics. Afterwards, the fabrics were laundered and examined as to staining. Any staining or discoloration of the fabric was found to be very low or non-existent. When these fabrics were subjected to contact with a leading wash cycle softener now on the market, in a like manner, the extent of fabric staining was found to be very severe.

While only certain embodiments of our invention have been described and demonstrated in detail it is apparent to those skilled in this art that our improved fabric softener compositions may be varied in many ways and many changes may be made all with the spirit of the invention and the scope of the appended claims.

What is claimed is:

1. A fabric softening composition comprising 0.1 to 35 weight percent of an amine oxide having the formula:

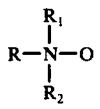

in which R is an alkyl radical containing a chain of from 8 to 22 carbon atoms and $R_1$ and $R_2$ are each methyl or ethyl, 0.1 to 45 weight percent of a first quaternary ammonium compound having the formula:

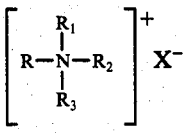

wherein R is an alkyl radical having a chain of 8 to 22 carbon atoms, $R_1$, $R_2$ and $R_3$ are each methyl or ethyl, and X is chlorine, bromine, fluorine, ethyl sulfate, methyl sulfate or $SO_4$, 0.1 to 60 weight percent of a second quaternary ammonium compound having the formula:

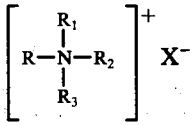

in which R is methyl, ethyl or 2-hydroxyethyl, preferably methyl, $R_1$ and $R_3$ are each ethyl or methyl, $R_2$ is $CH_2(CH_2CH_2O)_nH$, where n is from 8 to 41, and X is chlorine, bromine, iodine, ethyl sulfate, methyl sulfate or acetate, and 0.1 to 60 weight percent of a third quaternary ammonium compound having the formula:

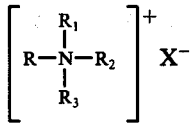

in which:

R is phenylalkyl in which the alkyl group contains a chain of 8 to 22 carbon atoms, $R_1$ and $R_2$ are each methyl or ethyl, $R_3$ is methyl, ethyl, or phenylalkyl in which the alkyl group contains a chain of 8 to 22 carbon atoms, and X is chlorine, bromine, iodine, ethyl sulfate or methyl sulfate, said percentages of said amine oxide first, second and third quaternary ammonium compounds being based on the dry weight of the respective compounds and the total weight of the composition, said amine oxide being contained in an amount of 35 to 65 weight percent based on the weight of the amine oxide and the total weight of the amine oxide and said first quaternary ammonium compound and said third quaternary ammonium compound containing at least in part an amount of compound containing two phenylalkyl groups in which each contains an alkyl radical of from 8 to 22 carbon atoms.

2. A composition as set forth in claim 1 in which said amine oxide is contained in an amount of from 2 to 12 weight percent, said first quaternary ammonium compound is contained in an amount of 2 to 12 weight percent, said second quaternary ammonium compound is contained in an amount of 1.5 to 20 weight percent and said third quaternary ammonium compound is contained in an amount of 1.5 to 20 weight percent, said percentages being based on the weight of the respective ingredients and the total weight of the composition.

3. A composition as set forth in claim 1 in which said amine oxide is contained in an amount of from about 4.0 weight percent, said first quaternary ammonium compound is contained in an amount of about 4.0 weight percent, said second quaternary ammonium compound is contained in an amount of 3.5 weight percent and said third quaternary ammonium compound is contained in an amount of 3.5 weight percent, said percentages being based on the weight of the respective ingredients and the total weight of the composition.

4. A composition as set forth in claim 1 containing 2 to 98 weight percent isopropanol and 0 to 96 weight percent water, said percentages being based on the respective ingredients and the total weight of the composition.

5. A composition as set forth in claim 1 in which R of said amine oxide contains a chain of 14 to 18 carbon atoms.

6. A composition as set forth in claim 5 in which said amine oxide contains a chain of 16 carbon atoms.

7. A composition as set forth in claim 1 in which the alkyl radical of phenylalkyl of said R group of said third quaternary ammonium compound contains a chain of 14 to 18 carbon atoms.

8. A composition as set forth in claim 1 in which R of said amine oxide, R of said first quaternary ammonium compound and alkyl group of the phenylalkyl groups contained in R and $R_3$, are each alkyl groups containing a chain of from 14 to 18 carbon atoms.

9. A composition as set forth in claim 1 in which at least one of $R_1$ and $R_2$ of said amine oxide is methyl.

10. A composition as set forth in claim 1 in which at least two of $R_1$, $R_2$ and $R_3$ of said first quanternary ammonium compound are methyl.

11. A composition as set forth in claim 1 in which X of said first quaternary ammonium compound is chlorine.

12. A composition as set forth in claim 1 in which said n is 8.

13. A composition as set forth in claim 1 in which X of said second quaternary ammonium compound is chlorine.

14. A composition as set forth in claim 1 in which X of said third quaternary ammonium compound is chlorine.

15. A composition as set forth in claim 1 in which said amine oxide is dimethyl hexadecyl amine oxide.

16. A composition as set forth in claim 1 in which said first quaternary ammonium compound is monococotrimethyl ammonium chloride.

17. A composition as set forth in claim 1 in which said second quaternary ammonium compound is diethyl methyl polypropoxy ammonium chloride.

18. A composition as set forth in claim 1 in which said third quaternary ammonium compound is dimethyl diphenylstearyl ammonium chloride.

19. A composition as set forth in claim 16 in which said first quaternary ammonium compound is monococotrimethyl ammonium chloride, said second quaternary ammonium compound is diethyl methyl polypropoxy ammonium chloride, and said third quaternary ammonium compound is dimethyl diphenylstearyl ammonium chloride.

* * * * *